US008182618B2

(12) United States Patent
Nozawa et al.

(10) Patent No.: US 8,182,618 B2
(45) Date of Patent: May 22, 2012

(54) RARE EARTH SINTERED MAGNET AND METHOD FOR PRODUCING SAME

(75) Inventors: Noriyuki Nozawa, Osaka (JP); Tomoori Odaka, Osaka (JP); Yutaka Matsuura, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 493 days.

(21) Appl. No.: 12/095,617

(22) PCT Filed: Nov. 30, 2006

(86) PCT No.: PCT/JP2006/324012

§ 371 (c)(1),
(2), (4) Date: May 30, 2008

(87) PCT Pub. No.: WO2007/063969

PCT Pub. Date: Jun. 7, 2007

(65) Prior Publication Data

US 2010/0148897 A1 Jun. 17, 2010

(30) Foreign Application Priority Data

Dec. 2, 2005 (JP) ..... 2005-349199

(51) Int. Cl.
*H01F 1/057* (2006.01)

(52) U.S. Cl. ..... 148/302; 148/101; 148/103

(58) Field of Classification Search ..... None
See application file for complete search history.

(56) References Cited

U.S. PATENT DOCUMENTS

| | | | | |
|---|---|---|---|---|
| 4,773,950 | A | 9/1988 | Fujimura et al. | |
| 4,975,129 | A | 12/1990 | Fujimura et al. | |
| 5,383,978 | A | 1/1995 | Yamamoto et al. | |
| 6,468,365 | B1 | 10/2002 | Uchida et al. | |
| 2003/0141951 | A1 | 7/2003 | Nakane et al. | |
| 2004/0020563 | A1 * | 2/2004 | Tokuhara et al. | 148/105 |
| 2004/0163737 | A1 * | 8/2004 | Tomizawa et al. | 148/302 |
| 2004/0189426 | A1 | 9/2004 | Hidaka et al. | |
| 2005/0098238 | A1 | 5/2005 | Morimoto et al. | |

FOREIGN PATENT DOCUMENTS

| | | | |
|---|---|---|---|
| EP | 1 462 531 | A2 * | 9/2004 |
| EP | 1641000 | A1 | 3/2006 |
| JP | 60-077959 | A | 5/1985 |
| JP | 05-047533 | A | 2/1993 |

(Continued)

OTHER PUBLICATIONS

Machine Translation of Japanese Patent Document 2005-179533 (Jul. 2005).*

(Continued)

*Primary Examiner* — John Sheehan
(74) *Attorney, Agent, or Firm* — Keating & Bennett, LLP

(57) ABSTRACT

A sintered rare-earth magnet includes an $Nd_2Fe_{14}B$ type crystalline phase as its main phase and Al as an additive. The magnet includes at least one light rare-earth element LR selected from the group consisting of yttrium and the rare-earth elements other than Dy, Ho and Tb, and at least one heavy rare-earth element HR selected from the group consisting of Dy, Ho and Tb. The mole fractions $\alpha1$, $\alpha2$ and $\beta$ of the light and heavy rare-earth elements LR and HR and Al satisfy the inequalities $25 \leqq \alpha1+\alpha2 \leqq 40$ mass %, $0<\alpha2 \leqq 40$ mass %, $\beta>0.20$ mass %, and $0.04 \leqq \beta/\alpha2 \leqq 0.12$.

4 Claims, 3 Drawing Sheets

FOREIGN PATENT DOCUMENTS

| | | | |
|---|---|---|---|
| JP | 05-074618 | * | 3/1993 |
| JP | 05-234733 | A | 9/1993 |
| JP | 2005-197533 | * | 7/2005 |

OTHER PUBLICATIONS

Certified Priority Document JP 2005-349199, Dec. 2, 2005.*
Official Communication issued in corresponding European Patent Application No. 068338151.1, mailed on Dec. 15, 2009.
Kim et al., "Microstructure of ZR Containing NDFEB", IEEE Transactions on Magnetics, vol. 33, No. 5, Sep. 1997, pp. 3823-3825.
Official communication issued in the International Application No. PCT/JP2006/324012, mailed on Feb. 27, 2007.
English translation of the official communication issued in counterpart International Application No. PCT/JP2006/324012, mailed on Jun. 12, 2008.

* cited by examiner

RARE EARTH SINTERED MAGNET AND METHOD FOR PRODUCING SAME

BACKGROUND OF THE INVENTION

1. Field of the Invention

The present invention relates to a sintered rare-earth magnet and a method for producing such a magnet.

2. Description of the Related Art

A rare-earth-iron-boron based sintered rare-earth magnet, which is a typical high-performance permanent magnet, has a structure including an $R_2Fe_{14}B$-type crystalline phase (main phase), which is a tetragonal compound, and grain boundary phases, and achieves excellent magnetic properties. In $R_2Fe_{14}B$, R is at least one element selected from the group consisting of the rare-earth elements and yttrium and includes Nd and/or Pr as its main ingredients, Fe is iron, B is boron, and these elements may be partially replaced with other elements. The grain boundary phases include an R-rich phase including a rare-earth element R at a relatively high concentration and a B-rich phase including boron at a relatively high concentration.

The rare-earth-iron-boron based sintered rare-earth magnet will be referred to herein as an "R-T-B based sintered magnet", where T is a transition metal element consisting essentially of iron. In the R-T-B based sintered magnet, an $R_2T_{14}B$ phase (main phase) is a ferromagnetic phase contributing to magnetization and the R-rich phase on the grain boundary is a low-melting nonmagnetic phase.

An R-T-B based sintered magnet is produced by compressing and compacting a fine powder (with a mean particle size of several μm) of a (mother) alloy to make an R-T-B based sintered magnet using a press machine and then sintering the resultant green compact. The sintered compact is then subjected to an aging treatment if necessary. The mother alloy to make such an R-T-B based sintered magnet is preferably made by an ingot process using die casting or by a strip casting process in which a molten alloy is quenched using a chill roller.

To produce an R-T-B based sintered magnet with high coercivity, it is proposed that Nd or Pr, which is used extensively as a rare-earth element R, be partially replaced with a heavy rare-earth element such as Dy or Tb (see Patent Document No. 1, for example). Since Dy and Tb are rare-earth elements with a highly anisotropic magnetic field, the coercivity can be increased effectively by replacing Nd with at least one of those elements at the site of the rare-earth element R in the main phase.

On the other hand, ever since the R-T-B based sintered magnet was developed, a very small amount of Al or Cu has been added to improve the coercivity (see Patent Document No. 2, for example). More specifically, when the R-T-B based sintered magnet was developed for the first time, Al and Cu were regarded as impurities that were inevitably contained in the material alloy. However, it was discovered afterward that Al and Cu are actually almost essential elements that should be added to increase the coercivity of the R-T-B based sintered magnet. It is also known that if Al and Cu were eliminated intentionally, the coercivity of the R-T-B based sintered magnet would be too low to actually use it in various applications.

Patent Document No. 1: Japanese Patent Application Laid-Open Publication No. 60-32306

Patent Document No. 2: Japanese Patent Application Laid-Open Publication No. 5-234733

The greater the amount of Dy, Tb or Ho added, the higher the coercivity can be. However, Dy, Tb and Ho are very rare elements. That is why if demands for highly refractory magnets to be used in motors for electric cars continue to grow as electric cars become increasingly popular in the near future, the Dy resources will soon be almost exhausted. In that case, there will be serious concerns about a potential upsurge of material costs. For that reason, it is an urgent task to develop some technique of reducing the amount of Dy to be used in high-coercivity magnets. Meanwhile, the additives Al and Cu would increase the coercivity but decrease the remanence $B_r$, which is also a problem.

SUMMARY OF THE INVENTION

In order to overcome the problems described above, preferred embodiments of the present invention provide a sintered rare-earth magnet that can have increased coercivity with a decrease in remanence minimized and with the amount of a heavy rare-earth element used, which would be required to achieve high coercivity, reduced as much as possible.

A sintered rare-earth magnet according to a preferred embodiment of the present invention includes an $Nd_2Fe_{14}B$ type crystalline phase as its main phase and Al as an additive. The magnet includes at least one light rare-earth element LR selected from the group consisting of yttrium and the rare-earth elements other than Dy, Ho and Tb, and at least one heavy rare-earth element HR selected from the group consisting of Dy, Ho and Tb. The mole fractions $\alpha1$, $\alpha2$ and $\beta$ of the light and heavy rare-earth elements LR and HR and Al satisfy the inequalities $25 \leqq \alpha1+\alpha2 \leqq 40$ mass %, $0<\alpha2 \leqq 40$ mass %, $\beta>0.20$ mass %, and $0.04 \leqq \beta/\alpha2 \leqq 0.12$.

In one preferred embodiment, the magnet further satisfies the inequality $4.0 \leqq \alpha2 \leqq 40$ mass %.

In another preferred embodiment, the magnet further includes 0.01 to 0.2 mass % of at least one additive element M that is selected from the group consisting of Si, Ti, V, Cr, Mn, Ni, Cu, Zn, Ga, Zr, Nb, Mo, Ag, In, Sn, Hf, Ta, W, Pb and Bi.

In still another preferred embodiment, the magnet is made of a sintered powder of a rapidly solidified alloy that has been obtained by a strip casting process.

A method for producing a sintered rare-earth magnet according to another preferred embodiment of the present invention includes the step of providing a rapidly solidified alloy that includes at least one light rare-earth element LR, at least one heavy rare-earth element HR and Al as an additive. The at least one light rare-earth element LR is selected from the group consisting of yttrium and the rare-earth elements other than Dy, Ho and Tb. The at least one heavy rare-earth element HR is selected from the group consisting of Dy, Ho and Tb. The mole fractions $\alpha1$, $\alpha2$ and $\beta$ of the light and heavy rare-earth elements LR and HR and Al satisfy the inequalities $25 \leqq \alpha1+\alpha2 \leqq 40$ mass %, $0<\alpha2 \leqq 40$ mass %, $\beta>0.20$ mass %, and $0.04 \leqq \beta/\alpha2 \leqq 0.12$. The method preferably further includes the steps of pulverizing the rapidly solidified alloy to make a powder, compacting the powder under a magnetic field to make a compact, and sintering the compact, thereby obtaining a sintered rare-earth magnet including an $Nd_2Fe_{14}B$ type crystalline phase as its main phase.

In one preferred embodiment, the step of providing a rapidly solidified alloy includes quenching a melt of a material alloy by a strip casting process.

In another preferred embodiment, the rapidly solidified alloy further satisfies the inequality $4.0 \leqq \alpha2 \leqq 40$ mass %.

In still another preferred embodiment, the rapidly solidified alloy includes 0.01 to 0.2 mass % of at least one additive element M that is selected from the group consisting of Si, Ti, V, Cr, Mn, Ni, Cu, Zn, Ga, Zr, Nb, Mo, Ag, In, Sn, Hf, Ta, W, Pb and Bi.

A sintered rare-earth magnet according to various preferred embodiments of the present invention changes the amounts of Al added according to the amount of the heavy rare-earth element such as Dy added. As a result, coercivity $H_{cJ}$ at the same level as the conventional magnet's can be achieved with a smaller amount of heavy rare-earth element and higher remanence $B_r$ is achieved as well.

Other features, elements, steps, characteristics and advantages of the present invention will become more apparent from the following detailed description of preferred embodiments of the present invention with reference to the attached drawings.

BRIEF DESCRIPTION OF DRAWINGS

In FIG. 1, the data points a through e indicated by the solid triangles ▲ represent Samples with a Dy concentration (corresponding to α2 mentioned above) of 4.0 mass % and the data points A through E indicated by the open squares □ represent Samples with a Dy concentration of 5.7 mass %.

DETAILED DESCRIPTION OF PREFERRED EMBODIMENTS

Figure 1:
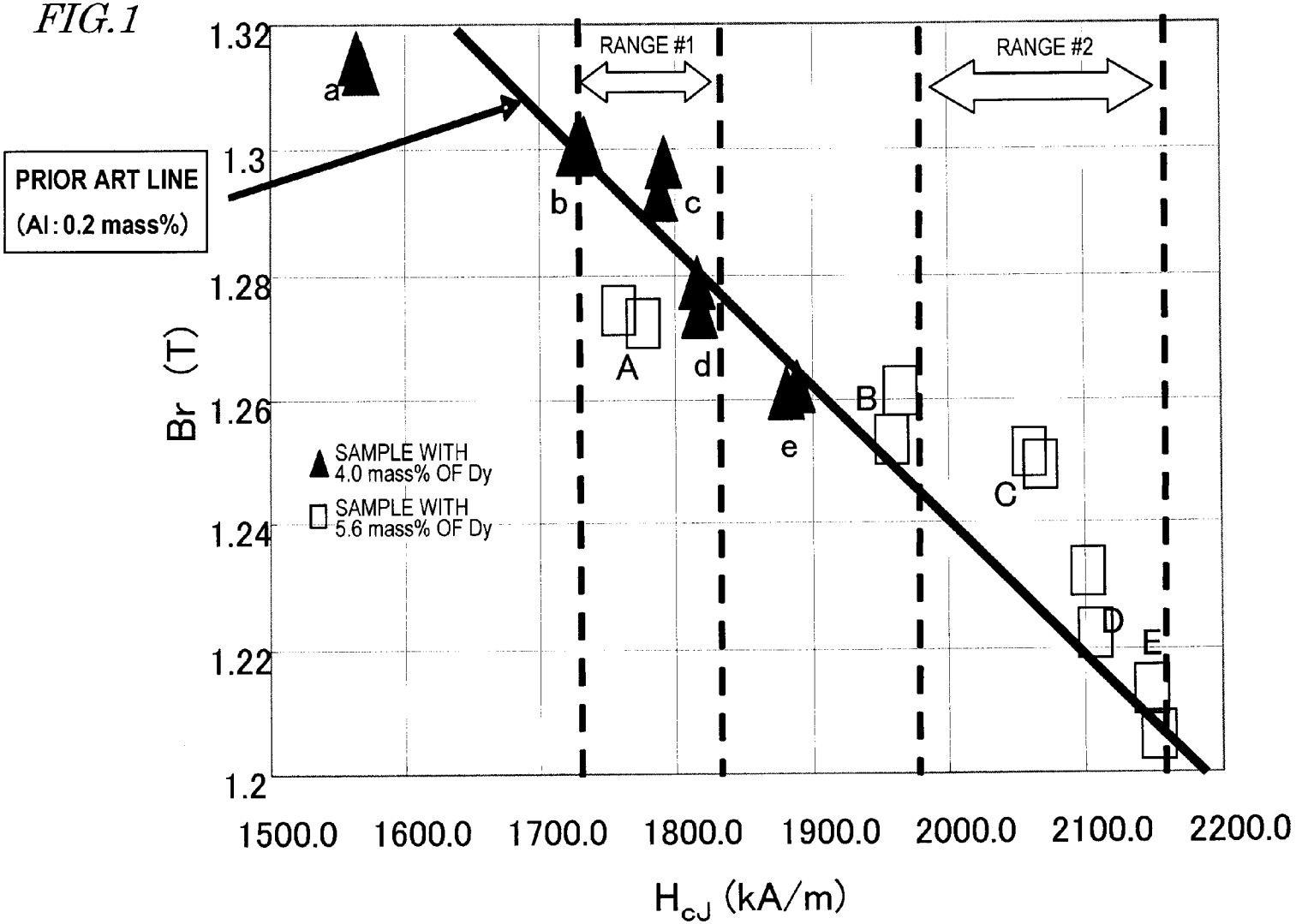
FIG. 1 is a graph showing how the remanence $B_r$ (unit: T) changed with the coercivity $H_{cJ}$ (kA/m) in Example #1 of the present invention and Comparative Example #1.

The present inventors discovered that if a rapidly solidified alloy having a fine structure in a non-equilibrium state should be made with the quenching rate of a molten alloy increased by adopting a strip casting process, the coercivity could be increased effectively with the decrease in remanence minimized by controlling the alloy composition such that the ratio of the amount of a heavy rare-earth element such as Dy added to that of Al added falls within a predetermined range, thus perfecting our invention.

In the prior art, it is known that by adding a very small amount of Al, the coercivity would increase but the saturation flux density would decrease. That is why the amount of Al added has been limited to about 0.2 mass %. On the other hand, according to the present invention, the amount of Al added is set higher than the conventional magnet's, thereby increasing the concentration of a heavy rare-earth element in the main phase itself on the grain boundary of crystals of an $Nd_2Fe_{14}B$ type compound as the main phase. As a result, the present invention can increase the coercivity even more effectively.

In a conventional sintered magnet that uses an ingot alloy to be made in a substantially thermal equilibrium state by slowly cooling a molten alloy, if more than 0.2 mass % of Al were added, the remanence would decrease. That is why it has been widely believed in the art that Al should not be added to such a high concentration. However, if the same molten alloy were quenched at a relatively high cooling rate of 10 to 1,000° C./s by a strip casting process, then the behaviors of Al and heavy rare-earth element added would be defined in a non-equilibrium state and the popular belief in the prior art might not be true. Under this idea, the present inventors carried out various experiments. As a result, we discovered that by controlling the ratio of the amount of Al added to that of the heavy rare-earth element added within a particular range and by setting the amount of Al added higher than the conventional magnet's, high coercivity can be achieved with the decrease in remanence minimized.

Hereinafter, preferred embodiments of a sintered rare-earth magnet according to the present invention will be described.

Material Alloy

First, a rapidly solidified alloy, including 25 mass % to 40 mass % of rare-earth elements R, 0.6 mass % to 1.6 mass % of B, 0.2 mass % to 5.0 mass % of Al, and Fe and inevitably contained impurities as the balance, is provided. In this case, the rare-earth earth elements R include a light rare-earth element LR and a heavy rare-earth element HR. The light rare-earth element LR is at least one element selected from the group consisting of yttrium and the rare-earth elements other than Dy, Ho and Tb. The heavy rare-earth element HR is at least one element selected from the group consisting of Dy, Ho and Tb. Optionally, a portion of (at most 50 at % of) Fe could be replaced with another transition metal element such as Co.

In this description, the mole fractions (in mass percentages) of the light rare-earth element LR, the heavy rare-earth element HR and Al to the entire magnet will be identified by α1, α2 and β, respectively, which satisfy the following inequalities:

$$25 \leqq \alpha1+\alpha2 \leqq 40 \text{ mass \%},$$

$$0<\alpha2 \leqq 40 \text{ mass \%},$$

$$\beta>0.20 \text{ mass \%, and}$$

$$0.04 \leqq \beta/\alpha2 \leqq 0.12.$$

If the mole fractions of R, B and Fe fell out of the ranges defined above, then an essential structure for an R-T-B based sintered magnet could not be formed and the desired magnetic properties could not be achieved. It should be noted that the light rare-earth element LR preferably includes at least 50% of Nd and/or Pr. Optionally, this rapidly solidified alloy may further include 0.01 to 0.2 mass % of at least one additive element M that is selected from the group consisting of Si, Ti, V, Cr, Mn, Ni, Cu, Zn, Ga, Zr, Nb, Mo, Ag, In, Sn, Hf, Ta, W, Pb and Bi.

This rapidly solidified alloy is obtained by quenching a molten alloy by a strip casting process. Hereinafter, it will be described how to make a rapidly solidified alloy by a strip casting process.

First, a molten alloy is prepared by melting a material alloy with the composition described above within an argon atmosphere by an induction melting process. Next, this molten alloy is maintained at 1,350° C. and then quenched by a single roller method, thereby obtaining alloy flakes with a thickness of about 0.3 mm, for example. The rapid solidification process may be performed at a roller peripheral velocity of about 1 m/s, a quenching rate of 500° C./s and a supercooling temperature of 200° C. The rapidly solidified alloy block obtained in this manner is pulverized into flakes with sizes of 1 mm to 10 mm before subjected to the next hydrogen pulverization process. Such a method of making a material alloy by a strip casting process is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This prevents oxidation or heat generation of the coarsely pulverized powder and improves the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to smaller sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically 3 to 5 μm) can be obtained. The pulverizing machine for use in such a fine pulverization process does not have to be a jet mill but may also be an attritor or a ball mill. Optionally, in this pulverization process, a lubricant such as zinc stearate may be used as a pulverization assistant.

Press Compaction Process

In this preferred embodiment, 0.3 wt % of lubricant is added to, and mixed with, the magnetic powder, obtained by the method described above, in a rocking mixer, thereby coating the surface of the alloy powder particles with the lubricant. Next, the magnetic powder prepared by the method described above is compacted under an aligning magnetic field using a known press machine. The aligning magnetic field to be applied may have a strength of 1.5 to 1.7 tesla (T), for example. Also, the compacting pressure is set such that the green compact will have a green density of approximately 4 to 4.5 g/cm$^3$, for example.

Sintering Process

The powder compact described above is preferably sequentially subjected to the process of maintaining the compact at a temperature of 650° C. to 1,000° C. for 10 to 240 minutes and then to the process of further sintering the compact at a higher temperature (of 1,000° C. to 1,200° C., for example) than in the maintaining process. Particularly when a liquid phase is produced during the sintering process (i.e., when the temperature is in the range of 650° C. to 1,000° C. ), the R-rich phase on the grain boundary starts to melt to produce the liquid phase. Thereafter, the sintering process advances to form a sintered magnet eventually. The sintered magnet may be subjected to an aging treatment at a temperature of 500° C. to 1,000° C. if necessary.

Hereinafter, specific examples of preferred embodiments of the present invention will be described.

Example #1 and Comparative Example #1

Sintered magnets were produced by performing the manufacturing process that has already been described for preferred embodiments of the present invention on a rapidly solidified alloy such that the sintered magnets would eventually have the compositions shown in the following Table 1.

TABLE 1

| | Nd α1 | Pr α1 | Dy α2 | Co | B | Cu | Al β | Fe | β/α2 |
|---|---|---|---|---|---|---|---|---|---|
| a | 20.8 | 6.25 | 4.0 | 0.9 | 1.0 | 0.1 | 0.07 | Balance | 0.018 |
| b | | | | | | | 0.17 | | 0.043 |
| c | | | | | | | 0.28 | | 0.070 |
| d | | | | | | | 0.43 | | 0.108 |
| e | | | | | | | 0.67 | | 0.168 |
| A | 19.8 | 5.50 | 5.7 | 0.9 | 1.0 | 0.1 | 0.06 | Balance | 0.011 |
| B | | | | | | | 0.19 | | 0.033 |
| C | | | | | | | 0.26 | | 0.046 |
| D | | | | | | | 0.41 | | 0.072 |
| E | | | | | | | 0.65 | | 0.114 |

In Table 1, Nd and Pr are light rare-earth elements LR and their combined mole fraction is identified by α1 (mass %). In this example, Dy (with a mole fraction α2 (mass %)) was used as a heavy rare-earth element HR and the mole fractions β (mass %) of Al added were changed as shown in Table 1. Samples c, d, C, D and E represent specific examples of the present invention, while Samples a, b, e, A and B represent comparative examples.

Rapidly solidified alloys with these compositions were made by a strip casting process and then pulverized. Before being pressed and compacted, the powder had a mean particle size of 4.4 μm to 4.6 μm. The compaction process was carried out under a magnetic field of 1.7 T. The resultant compacts were subjected to a sintering process at a temperature of 1,000° C. to 1,100° C. for four hours and then to an aging treatment at a temperature of 580° C. to 660° C. for two hours. The sintered bodies thus obtained had a rectangular parallelepiped shape with dimensions of 20 mm×50 mm×10 mm.

FIG. 1 is a graph showing how the remanence $B_r$ (unit: T) changed with the coercivity $H_{cJ}$ (kA/m). In FIG. 1, the data points a through e indicated by the solid triangles ▲ represent Samples with a Dy concentration (corresponding to α2 mentioned above) of 4.0 mass % and the data points A through E indicated by the open squares □ represent Samples with a Dy concentration of 5.7 mass %.

The bold solid line (prior art line) shown in the graph of FIG. 1 shows a typical relation between the remanence $B_r$ (unit: T) and the coercivity $H_{cJ}$ (kA/m) in conventional sintered magnets. This line is defined based on data about samples with an Al concentration (corresponding to β mentioned above) of 0.2 mass %. And this line clearly shows that the higher the coercivity $H_{cJ}$, the lower the remanence $B_r$.

Look at samples with a Dy concentration of 4.0 mass %. As can be seen from FIG. 1, if the Al concentration was 0.2 mass % or less as in Samples a and b, their data points are located on, or on the left-hand side of, the prior art line. However, once the Al concentration exceeds 0.2 mass %, the higher the Al concentration, the higher the coercivity $H_{cJ}$ but the lower the remanence $B_r$. Nevertheless, the rate of decrease in remanence $B_r$ was less than expected, considering the rate of increase in coercivity $H_{cJ}$ (as in Samples c and d). As the Al concentration further increases, the rate of decrease in remanence $B_r$ in turn becomes more significant than the rate of increase in coercivity $H_{cJ}$.

Meanwhile, looking at samples with a Dy concentration of 5.7 mass %, it can be seen that if the Al concentration was 2.0 mass % or less as in Samples A and B, their data points are located on, or on the left-hand side of, the prior art line. However, once the Al concentration exceeds 0.2 mass %, the higher the Al concentration, the higher the coercivity $H_{cJ}$ but the lower the remanence $B_r$. Nevertheless, as in the situation where the Dy concentration was 4.0 mass %, the rate of decrease in remanence $B_r$ was less than expected, considering the rate of increase in coercivity $H_{cJ}$ (as in Samples C through E). But if the Al concentration becomes too high, then the data points will be located on the left-hand side of the line.

These results reveal that by setting the Al concentration higher than the conventional magnet's, the coercivity $H_{cJ}$ can be increased with the decrease in remanence $B_r$ minimized. This should be a unique phenomenon that can be observed only if a molten alloy is quenched by a strip casting process. The present inventors also discovered that if the Al concentration was defined so high as to go beyond a predetermined ratio range with respect to the concentration of a heavy rare-earth earth element HR such as Dy, then the remanence $B_r$ decreased significantly. That is to say, the range in which the decrease in remanence can be minimized by increasing the amount of Al added is very narrow and is determined by the amount of Dy added.

This phenomenon was observed in a rapidly solidified alloy to which both Al and a heavy rare-earth element were added. This should be because Al, which was added at a higher concentration than the conventional magnet's, would have been introduced into the grain boundary of the main phase during the rapid solidification process and would have driven the heavy rare-earth element, which should have stayed in the grain boundary at a lower Al concentration, out of the grain boundary and into the main phase.

The present inventors also discovered that such an effect produced by adding Al was significant only when the heavy rare-earth element had a concentration of 4 mass % or more. By taking advantage of such an effect achieved by the additive Al, the minimum required concentration of the heavy rare-earth element for realizing desired high coercivity $H_{cJ}$ can be lower than the one set for conventional magnets. As a result, the amount of the heavy rare-earth element to add, which is one of very rare and valuable natural resources, can be reduced.

According to the results of experiments the present inventors carried out, to achieve good properties represented by the right half of the graph shown in FIG. 1, which is located on the right-hand side of the prior art line, the inequalities $25 \leqq \alpha 1 + \alpha 2 \leqq 40$ mass %, $0 < \alpha 2 \leqq 40$ mass %, $\beta > 0.20$ mass %, and $0.04 \leqq \beta/\alpha 2 \leqq 0.12$ should be satisfied.

Also, the ratio $\beta/\alpha 2$ of the Al concentration (mole fraction) to the concentration (mole fraction) of a heavy rare-earth element such as Dy preferably satisfies $0.042 \leqq \beta/\alpha 2 \leqq 0.11$, and more preferably satisfies $0.044 \leqq \beta/\alpha 2 \leqq 0.10$.

In the example described above, Dy is used as a heavy rare-earth element. However, the same effect can be achieved even by adding Ho or Tb. Optionally, a portion of B may be replaced with carbon (C).

Example #2 and Comparative Example #2

Rapidly solidified alloys were prepared and then subjected to the same manufacturing process as that of Example #1 and Comparative Example #2 described above such that the resultant sintered magnets would have the compositions shown in the following Table 2. These sintered magnets will be referred to herein as Samples #1 through #4. The present inventors also measured the magnetic properties of those sintered magnets. The results are shown in the following Table 3.

TABLE 2

| Sample | Nd α1 | Pr α1 | Dy α2 | Tb α2 | Co | B | Cu | Al β | Fe | β/α2 | Note |
|---|---|---|---|---|---|---|---|---|---|---|---|
| #1 | 18.7 | 5 | 7.5 | 0 | 0.9 | 1 | 0.1 | 0.05 | Bal. | 0.007 | Cmp. |
| #2 | 18.7 | 5 | 7.5 | 0 | 0.9 | 1 | 0.1 | 0.22 | Bal. | 0.029 | Cmp. |
| #3 | 18.7 | 5 | 7.5 | 0 | 0.9 | 1 | 0.1 | 0.38 | Bal. | 0.051 | Ex. |
| #4 | 18.7 | 5 | 7.5 | 0 | 0.9 | 1 | 0.1 | 0.58 | Bal. | 0.077 | Ex. |

TABLE 3

| Sample | Br (T) | HcJ (kA/m) | Note |
|---|---|---|---|
| #1 | 1.235 | 2030 | Cmp. Ex. |
| #2 | 1.220 | 2165 | Cmp. Ex. |
| #3 | 1.200 | 2340 | Example |
| #4 | 1.180 | 2440 | Example |

Figure 2:
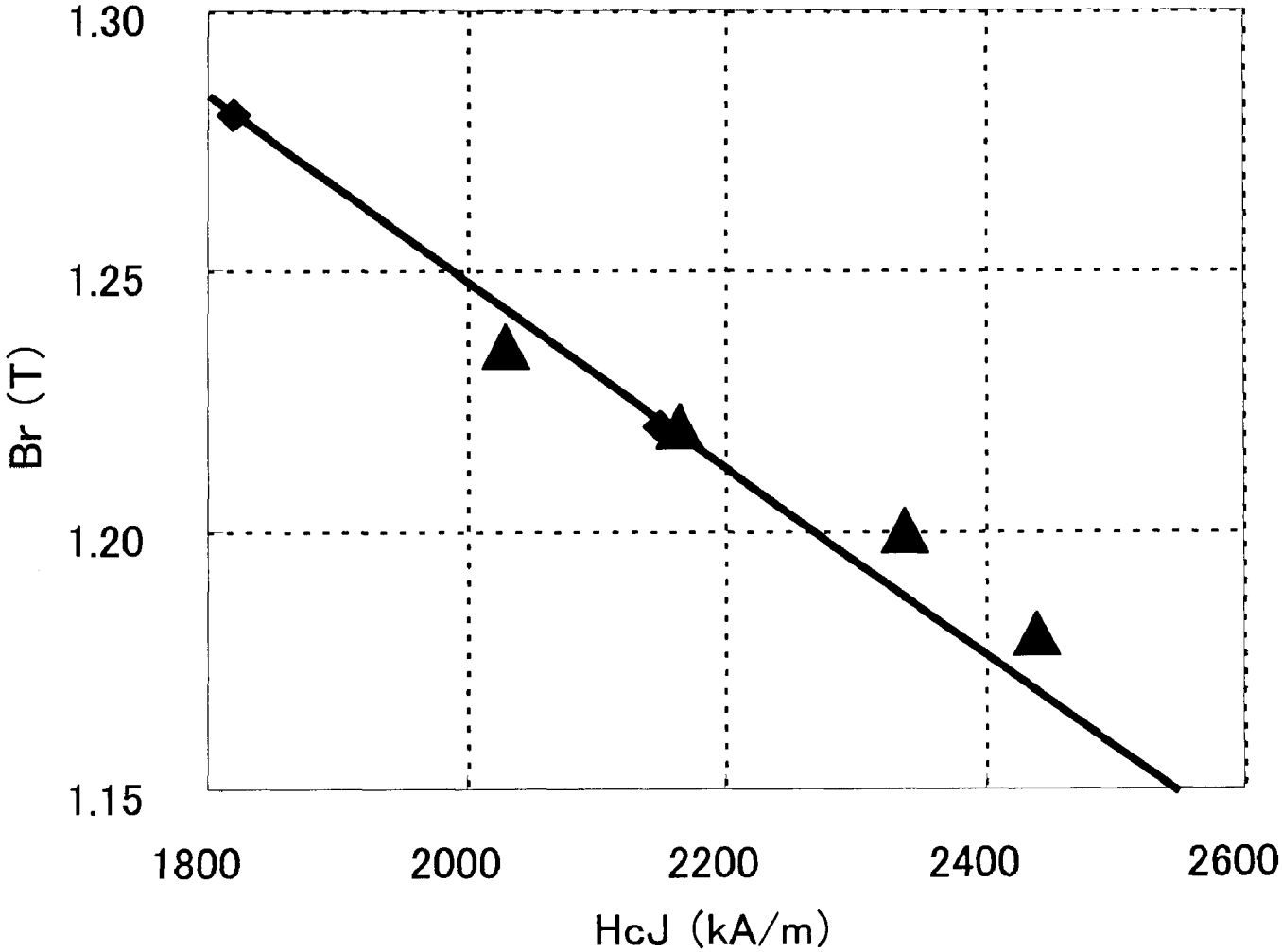
FIG. 2 is a graph showing how the remanence $B_r$ (unit: T) changed with the coercivity $H_{cJ}$ (kA/m) in Example #2 of the present invention and Comparative Example #2.

FIG. 2 is a graph corresponding to Table 3 and shows the prior art line with Al=0.2 mass % (represented by the solid diamonds ♦) and the data points of Samples #1 through #4 to which 7.5 mass % of Dy was added (represented by the solid triangles ▲).

In FIG. 2, Samples #3 and #4 satisfying the inequality $0.04 \leqq \beta/\alpha 2 \leqq 0.12$ represent specific examples of the present invention, while Samples #1 and #2 represent comparative examples. Samples #3 and #4 achieved coercivities $H_{cJ}$ exceeding 2300 kA/m, which were higher than those represented by the prior art line.

Example #3 and Comparative Example #3

Rapidly solidified alloys were prepared and then subjected to the same manufacturing process as that of Example #1 and Comparative Example #2 described above such that the resultant sintered magnets would have the compositions shown in the following Table 4. These sintered magnets will be referred to herein as Samples #5 through #9, to each of which 1.0 mass % of Tb was added. The present inventors also measured the magnetic properties of those sintered magnets. The results are shown in the following Table 5.

TABLE 4

| Sample | Nd α1 | Pr α1 | Dy α2 | Tb α2 | Co | B | Cu | Al β | Fe | β/α2 | Note |
|---|---|---|---|---|---|---|---|---|---|---|---|
| #5 | 22.2 | 5 | 3.0 | 1.0 | 0.9 | 1 | 0.1 | 0.05 | Bal. | 0.013 | Cmp. |
| #6 | 22.2 | 5 | 3.0 | 1.0 | 0.9 | 1 | 0.1 | 0.20 | Bal. | 0.050 | Cmp. |
| #7 | 22.2 | 5 | 3.0 | 1.0 | 0.9 | 1 | 0.1 | 0.35 | Bal. | 0.088 | Ex. |
| #8 | 22.2 | 5 | 3.0 | 1.0 | 0.9 | 1 | 0.1 | 0.41 | Bal. | 0.103 | Ex. |
| #9 | 22.2 | 5 | 3.0 | 1.0 | 0.9 | 1 | 0.1 | 0.62 | Bal. | 0.155 | Cmp. |

TABLE 5

| Sample | Br (T) | HcJ (kA/m) | Note |
|---|---|---|---|
| #5 | 1.315 | 1600 | Cmp. Ex. |
| #6 | 1.303 | 1760 | Cmp. Ex. |
| #7 | 1.295 | 1895 | Example |
| #8 | 1.290 | 1940 | Example |
| #9 | 1.267 | 1990 | Cmp. Ex. |

Figure 3:
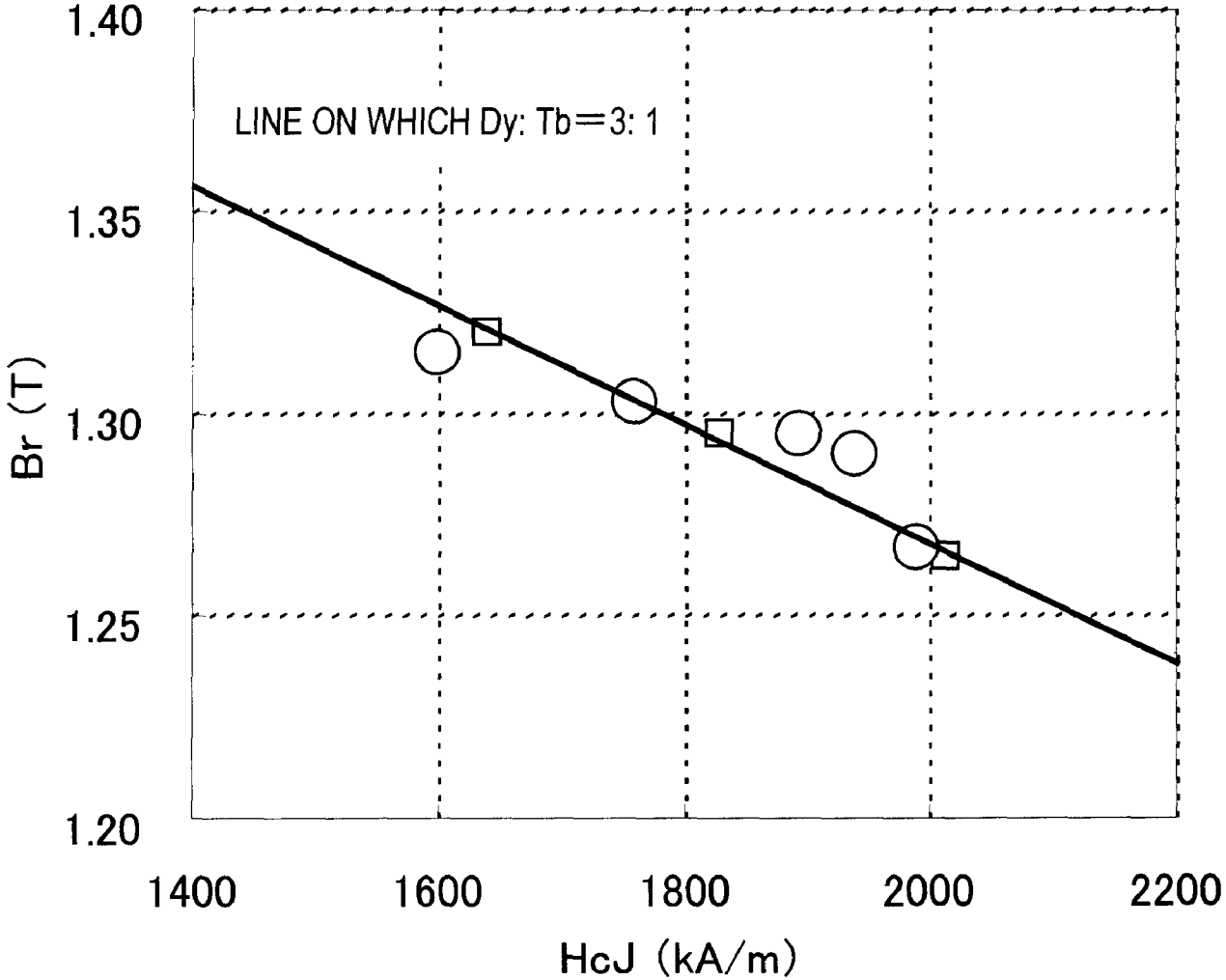
FIG. 3 is a graph showing how the remanence $B_r$ (unit: T) changed with the coercivity $H_{cJ}$ (kA/m) in Example #3 of the present invention and Comparative Example #3.

FIG. 3 is a graph corresponding to Table 5 and shows the prior art line in which Dy and Tb were added at a ratio of three to one as heavy rare-earth elements HR (represented by the open squares □) and the data points of Samples #5 through #9 to which Tb was added (represented by the open circles ○).

Samples #5 through #9 represent specific examples of the present invention and comparative examples, to which varying amounts of Al were added as shown in Table 4. As can be seen from FIG. 3 and Table 5, Samples #7 and #8 representing specific examples of the present invention achieved better properties than the prior art line.

These results reveal that the same effects were achieved even by a composition including not just Dy but also Tb as heavy rare-earth additives.

The sintered rare-earth magnet according to various preferred embodiments of the present invention can exhibit increased coercivity with the decrease in remanence minimized, and therefore, would require a smaller amount of a heavy rare-earth element as an indispensable additive to achieve that high coercivity. As a result, the present invention would contribute to safeguarding rare and valuable natural resources.

In addition, the sintered rare-earth magnet of the present invention not only achieves high coercivity but also minimizes the decrease in remanence, and therefore, can be easily formed in a reduced size. Consequently, the rare-earth magnets of the present invention can be used effectively in motors for hybrid engines and various other applications that would require both high coercivity and high remanence alike.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

The invention claimed is:

1. A sintered rare-earth magnet comprising an $Nd_2Fe_{14}B$ type crystalline phase as its main phase and Al as an additive; wherein the rare-earth magnet includes at least one light rare-earth element LR selected from the group consisting of yttrium and the rare-earth elements other than Dy, Ho and Tb, and at least one heavy rare-earth element HR selected from the group consisting of Dy, Ho and Tb; and $\alpha1$, $\alpha2$ and $\beta$ of the light and heavy rare-earth elements LR and HR and Al satisfy the inequalities $$25 \leqq \alpha1+\alpha2 \leqq 40 \text{ mass \%},$$

$$4.0 \leqq \alpha2 \leqq 40 \text{ mass \%},$$

$$\beta \geqq 0.35 \text{ mass \%, and}$$

$$0.04 \leqq \beta/\alpha2 \leqq 0.12; \text{ and}$$

the rare-earth magnet further includes 0.01 to 0.2 mass % of at least one additive element M that is selected from the group consisting of Si, Ti, V, Cr, Mn, Ni, Cu, Zn, Ga, Zr, Nb, Mo, Ag, In, Sn, Hf, Ta, W, Pb and Bi.

2. The sintered rare-earth magnet of claim 1, wherein the magnet is made of a sintered powder of a rapidly solidified alloy that has been obtained by a strip casting process.

3. A method for producing a sintered rare-earth magnet, the method comprising the steps of:

providing a rapidly solidified alloy that includes at least one light rare-earth element LR, at least one heavy rare-earth element HR and Al as an additive, the at least one light rare-earth element LR being selected from the group consisting of yttrium and the rare-earth elements other than Dy, Ho and Tb, the at least one heavy rare-earth element HR being selected from the group consisting of Dy, Ho and Tb, $\alpha1$, $\alpha2$ and $\beta$ of the light and heavy rare-earth elements LR and HR and Al satisfying the inequalities $25 \leqq \alpha1+\alpha2 \leqq 40$ mass %, $4.0 \leqq \alpha2 \leqq 40$ mass %, $\beta \geqq 0.35$ mass %, and 0 $04 \leqq \beta/\alpha2 \leqq 0.12$;

pulverizing the rapidly solidified alloy to make a powder;

compacting the powder under a magnetic field to make a compact; and sintering the compact, thereby obtaining a sintered rare-earth magnet including an $Nd_2Fe_{14}B$ type crystalline phase as its main phase; wherein the rapidly solidified alloy includes 0.01 to 0.2 mass % of at least one additive element M that is selected from the group consisting of Si, Ti, V, Cr, Mn, Ni, Cu, Zn, Ga, Zr, Nb, Mo, Ag, In, Sn, Hf, Ta, W, Pb and Bi.

4. The method of claim 3, wherein the step of providing a rapidly solidified alloy includes quenching a melt of a material alloy by a strip casting process.

* * * * *